US005970592A

United States Patent [19]

Feldhoff et al.

[11] Patent Number: 5,970,592

[45] Date of Patent: Oct. 26, 1999

[54] GODET FOR HEATING A RUNNING SYNTHETIC THREAD

[75] Inventors: Ralf Feldhoff, Radevormwald; Stefan Tietmeyer, Witten; Rainald Voss, Wermelskirchen, all of Germany

[73] Assignee: Barmag Ag, Remscheid, Germany

[21] Appl. No.: 09/011,848

[22] PCT Filed: Jun. 16, 1997

[86] PCT No.: PCT/EP97/03121

§ 371 Date: Feb. 18, 1998

§ 102(e) Date: Feb. 18, 1998

[87] PCT Pub. No.: WO97/49265

PCT Pub. Date: Dec. 24, 1997

[30] Foreign Application Priority Data

Jun. 18, 1996 [DE] Germany ..... 196 24 266

[51] Int. Cl.[6] ..... D02J 1/22; H05B 6/14

[52] U.S. Cl. ..... 28/240; 219/619; 219/671; 219/469

[58] Field of Search ..... 28/240, 241, 242, 28/243, 244, 245, 246; 219/619, 671, 469, 652, 674, 211, 470; 492/46

[56] References Cited

U.S. PATENT DOCUMENTS

| | | | |
|---|---|---|---|
| 3,412,229 | 11/1968 | Seagrave, Jr. . | |
| 3,448,233 | 6/1969 | Landis . | |
| 3,487,187 | 12/1969 | Martens et al. . | |
| 3,508,024 | 4/1970 | Cannon . | |
| 3,529,116 | 9/1970 | Miyagi . | |
| 3,562,489 | 2/1971 | Lenk . | |
| 3,581,060 | 5/1971 | Bauer . | |
| 4,647,744 | 3/1987 | Kitano et al. . | |
| 5,159,166 | 10/1992 | Arnosti et al. . | |
| 5,362,945 | 11/1994 | Baader . | |
| 5,421,070 | 6/1995 | Lenk . | |
| 5,665,043 | 9/1997 | Hasselberg et al. | 28/240 |

FOREIGN PATENT DOCUMENTS

| | | |
|---|---|---|
| 0 349 829 | 1/1990 | European Pat. Off. . |
| 1 565 149 | 10/1970 | Germany . |
| 858855 | 1/1961 | United Kingdom . |
| 989349 | 4/1965 | United Kingdom . |
| 1 202 816 | 8/1970 | United Kingdom . |
| 1 319 318 | 6/1973 | United Kingdom . |
| 2 162 729 | 2/1986 | United Kingdom . |

*Primary Examiner*—Amy Vanatta
*Attorney, Agent, or Firm*—Alston & Bird LLP

[57] ABSTRACT

A godet for heating an advancing synthetic filament yarn is provided, the godet comprising a plurality of stationary primary windings and, with respect thereto, a magnetically conductive, rotatably supported godet jacket. The godet jacket is coupled with the primary windings via a defined radial clearance extending between same and the side walls of the primary winding carrier for generating induced currents. The carriers are constructed such that their transformer sheets radially overlie each other in the region of their channel bottom, thereby shielding the magnetic flux outward, in particular toward the coil support.

15 Claims, 5 Drawing Sheets

GODET FOR HEATING A RUNNING SYNTHETIC THREAD

BACKGROUND OF THE INVENTION

The invention relates to a godet for heating an advancing filament yarn.

U.S. Pat. No. 3,508,024 describes a godet for heating an advancing yarn wherein the godet has more than two axially adjacent stationary primary windings and a magnetically conductive godet jacket. The jacket is supported for rotation in concentric relationship with the primary windings, and is inductively connected with the primary windings via a narrow radial clearance for generating secondary currents. The carrier of the primary windings is built up from several laminated transformer sheets, which are arranged perpendicular to the axis of a coil support. A trigger circuit operates each of the primary windings with an alternating current of adjustable frequency, the primary windings being included in an oscillation circuit, which is adapted to the adjusted frequency. Via corresponding power switches in cooperation with associated temperature controllers, the oscillation circuit can be connected or disconnected as a function of the temperature measured on the godet jacket.

A similar godet is described in GB 989,349, wherein a primary winding is mounted on a circular carrier arranged in concentric relationship with a hollow cylindrical godet jacket. In the same manner as in U.S. Pat. No. 3,508,024, all flat transformer sheets of the carrier accommodating the primary windings are laminated on a coil support in axial direction. With respect to the inner surface of the godet jacket, the laminated iron sheets are arranged such as to form annular air gaps radially concentric with the axis of rotation of the godet.

In general with such heated godets, the problem arises that the loss of the magnetic flux toward the outside, in particular toward the coil support is relatively great, since all flat transformer sheets of the carrier of the primary windings are laminated on the coil support in the axial direction. Likewise, the magnetic flux in the thus-constructed carrier is not optimal, since axially adjacent transformer sheets form boundary layers. To overcome these boundary layers, a certain energy is required, which causes a loss of power. In particular, in a high-frequency application at, for example, 2 kHz and higher, the power loss increases significantly because of thicker boundary layers.

It is therefore the object of the invention to provide a heatable godet of the above-outlined kind, which permits an optimal magnetic flux in the godet by preventing a leakage field within the godet jacket, in particular in the region of the channel bottoms of the carrier, and by reducing the power loss caused by the boundary layers.

SUMMARY OF THE INVENTION

The above and other objects and advantages are achieved by the provision of a godet which has a plurality of annular U-shaped carriers mounted in an axially adjacent arrangement along a fixed tubular coil support so that the carriers lie between the coil support and the tubular wall of the yarn engaging jacket of the godet. The carriers comprise a bottom wall and opposite side walls, and the bottom wall of each carrier comprises a plurality of axially extending transformer sheets which radially overlie each other. Preferably, the side walls of each of the carriers comprise a plurality of transformer sheets which extend radially and overlie each other in the axial direction. An induction coil is mounted coaxially within each of the annular carriers, such that when an alternating current is delivered to the induction coils a secondary current is induced in the tubular wall of the jacket to thereby heat the jacket.

Since the magnetic flux, in particular toward the coil support is shielded, a leakage field is prevented from escaping outward. This permits obtaining in addition an optimal magnetic flux, which need not overcome boundary layers, and which effectively shields sections not being heated.

The special construction and arrangement of the transformer sheets ensure an improved heating of the godet jacket, since the leakage field within the godet is considerably reduced.

A further advantage lies in that it is possible to use commercially available cut strip cores for receiving the windings. This simplifies the process of manufacture and reduces the costs. A clearance formed between adjacent cut strip cores leads to only a very small leakage field, which has no influence on the generated power and, thus, on the temperature in the godet jacket.

The surface configuration of the channel bottom above which the carrier is arranged on the coil support simplifies assembly.

Likewise, it is possible to use for a high-frequency application thin transformer sheets with a thickness as small as 0.01 mm. Since the depth of penetration of the magnetic flux decreases as the frequency increases, and since conduction of the magnetic flux occurs however exclusively on the surface, such thin sheets are useful for keeping dissipation of power as low as possible.

BRIEF DESCRIPTION OF THE DRAWINGS

Further advantages, features, and uses of the invention are described in more detail with reference to an embodiment and the attached drawing. In the drawing.

DETAILED DESCRIPTION OF THE PREFERRED EMBODIMENTS

Figure 1:
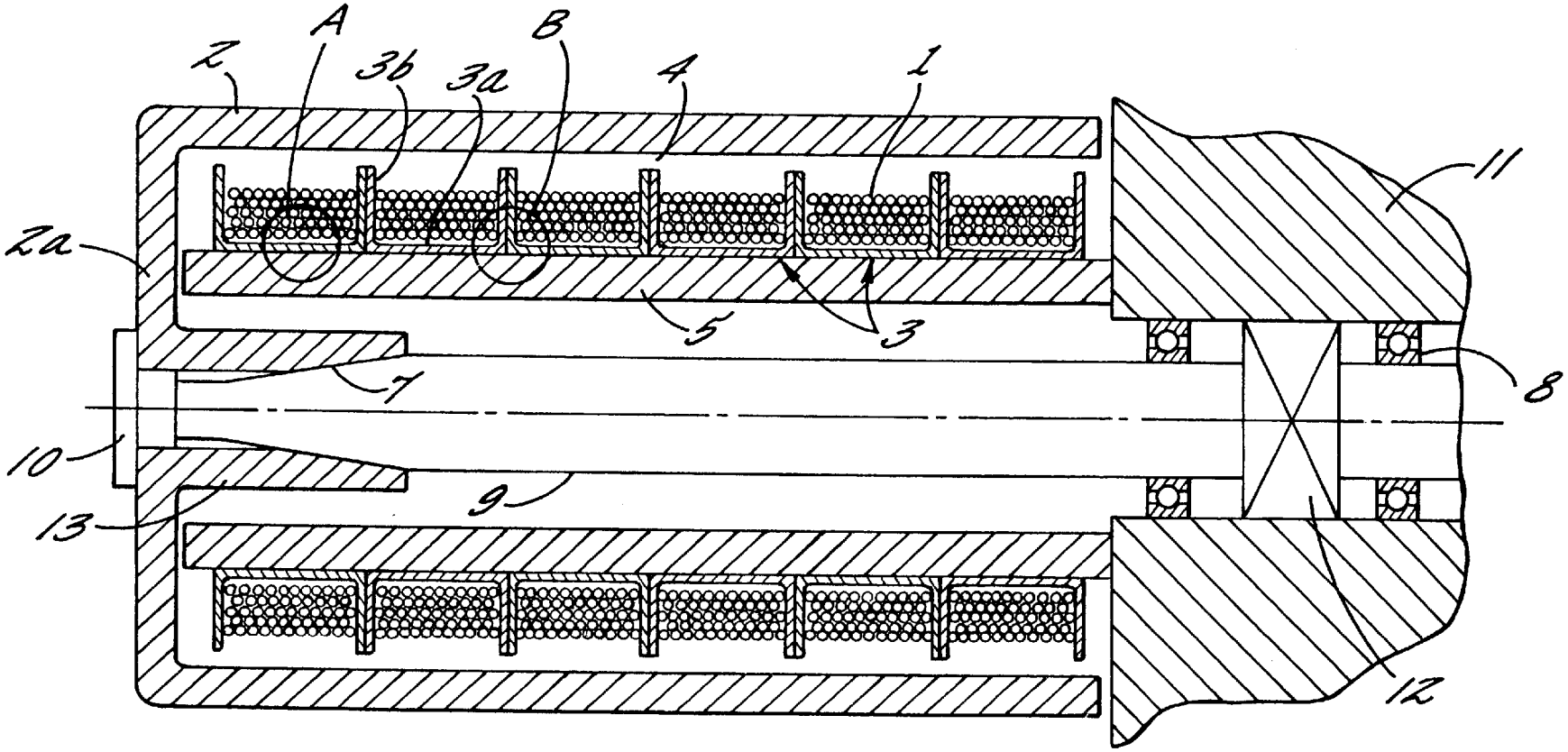
FIG. 1 is a sectional view of an inductively heated godet.

In an inductively heated godet as shown in FIG. 1, a plurality of channel-type carriers 3 are arranged axially on a coil support 5, each carrier accommodating a primary winding 1. A godet jacket 2 is secured by means of a cone arrangement 7 on a spindle 9 supported in two bearings 8. The bearings 8 are supported in a stationary housing 11. The godet jacket 2 has a substantially U-shaped cross section and at its front wall 2*a* a central opening, which is bounded by a substantially cylindrical, inward directed extension 13, which has an inside taper 7 adapted to a taper of spindle 9. Located at the free end of spindle 9 is a screw thread, which receives a nut 10 for securing godet jacket 2 on spindle 9. From housing 11, the coil support 5 extends in the form of a hollow cylinder along spindle 9 almost as far as the front wall 2*a* of godet jacket 2. Arranged in an axial direction on coil support 5 are a plurality of carriers 3, one following the other over the circumference of coil support 5. Each carrier 3 comprises a channel bottom 3*a* and spaced-apart side walls 3*b*, so that a U-shaped annular space is formed which serves to receive primary winding 1. The side walls 3*b* extend radially almost as far as the inside surface of godet jacket 2. Two adjacent side walls 3*b* form each with the inner jacket surface a defined radial clearance 4 of a dimension corresponding to the side wall width.

Via a corresponding control unit (not shown), the primary windings 1 arranged on carriers 3 are separately controllable, so that a substantially constant temperature can be reached along the outer surface of godet jacket 2. The annular clearances 4 between side walls 3*b* and the inner surface of godet jacket 2, which is magnetically conductive, permit magnetic coupling of rotating godet jacket 2, so that a voltage is induced in the godet jacket, which results in a current flow. The current flow in the godet jacket along the circumference thereof results in heating caused by the electrical resistance of the godet material. Thus, purposeful connection and disconnection of the coil voltage permits adjustment of the temperature in the godet jacket. To prevent power losses, in particular, in the case of a high-frequency application of, for example, 2 kHz and higher, the transformer sheets are arranged in the channel bottom such that they overlie one another in radial direction.

Figure 2:
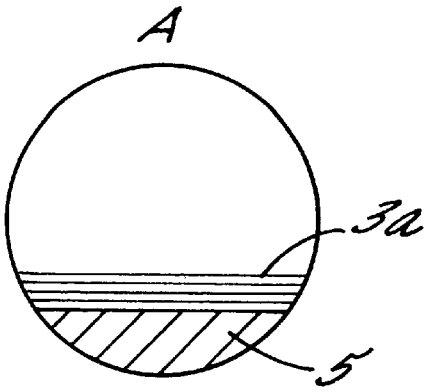
FIG. 2 is an enlarged illustration of the channel bottom in region A of FIG. 1.

Shown in FIG. 2 is a locally enlarged sectional view of channel bottom 3*a*, wherein the transformer sheets are stacked radially one atop the other in the region of the channel bottom.

Figure 3:
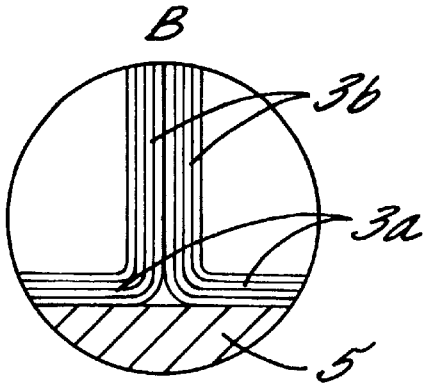
FIG. 3 shows an embodiment of a carrier in region B of FIG. 1, the carrier comprising several transformer sheets stacked atop one another in U-shape.
Figure 5:
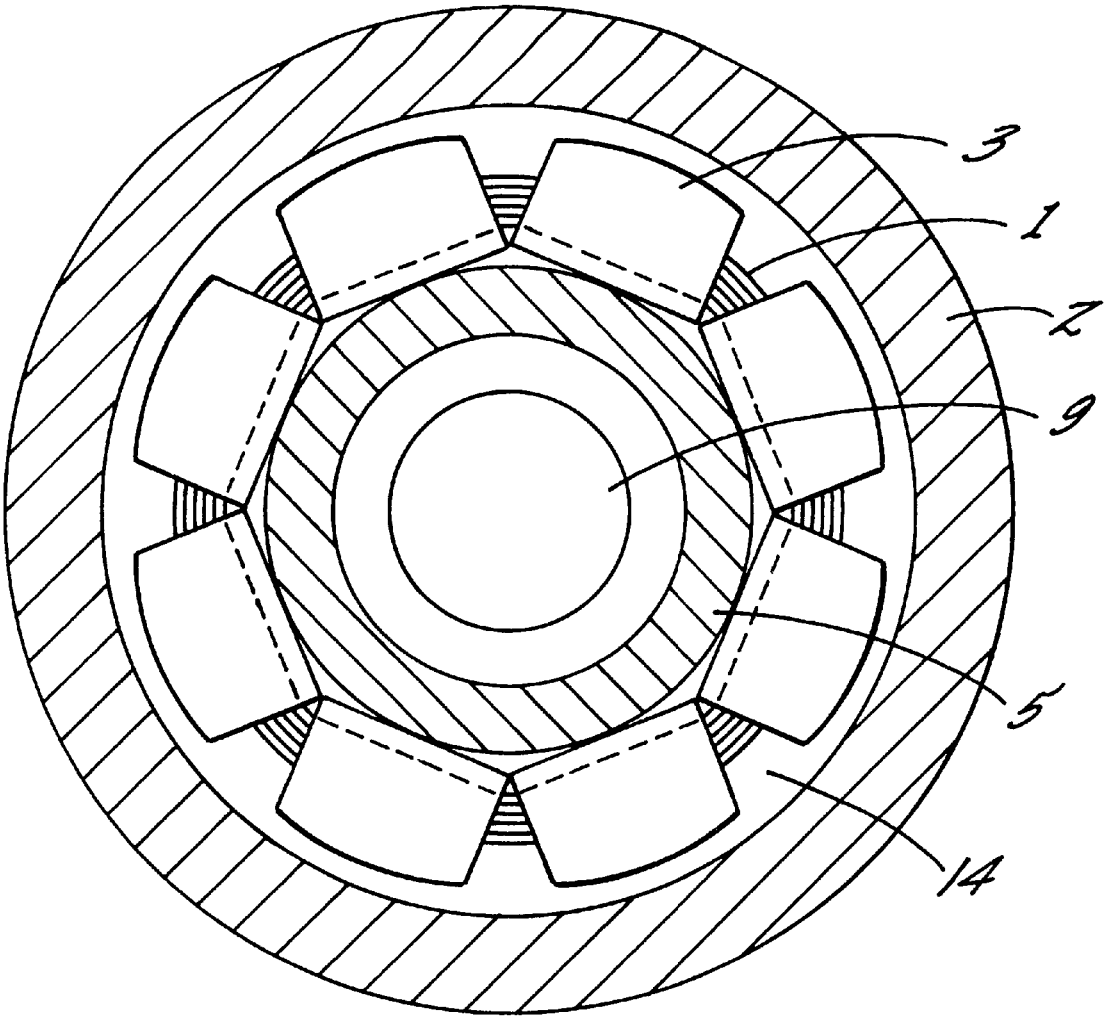
FIG. 5 is a sectional view of the godet of FIG. 1, which shows the arrangement of a plurality of segmentlike cut strip cores over the circumference of the coil support.

FIGS. 3 and 5 show a preferred embodiment, wherein the carriers 3 are formed such that the laminated transformer sheets are stacked into one another in U-shape to form so-called cut strip cores, i.e., the transformer sheets are laminated in radial direction and not—as is commonly known—in axial direction. Arranged over the circumference of the coil support 5 is a plurality of U-shaped cut strip cores 3 in the form of a plurality of segments. Thus, the cut strip cores 3, which are arranged over the circumference of the coil support in circumferential direction without a spacing therebetween, form a carrier for a primary winding. The advantage of using cut strip cores 3 lies in that the magnetic flux is shielded outward, in particular also toward coil support 5, so as to prevent a leakage field from escaping outward. To this end, the laminated transformer sheets are stacked into one another in U-shape. This facilitates in addition an optimal magnetic flux, which need not overcome boundary layers. In the case of transformer sheets which are arranged one after the other in axial direction, thicker boundary layers are produced when using a high frequency of, for example, 2 kHz. These boundary layers lead to a considerable increase of resistance. The surface of channel bottom 3*a*, which mounts cut strip core 3 to coil support 5, is either substantially flat or adapted to the surface of support 5, and it contacts the surface of support 5. The winding extends in the circumferential direction. The free ends of side walls 3*b* of the cut strip cores are rounded such that a substantially constant radial clearance 4 forms between godet jacket 2 and the free end of side walls 3*b*. A gap 14 formed between adjacent cut strip cores 4 causes only a very slight leakage field, which has no influence on the generated current and, thus, the temperature in godet jacket 2. To minimize losses caused by the leakage field, cut strip cores of adjacent primary windings may be offset from one another, so that gaps 14 form which are axially bounded by the width of side walls 3*b*.

Figure 4A:
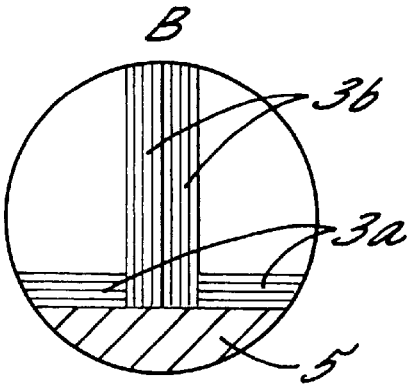
FIGS. 4A–4C illustrate further embodiments of a cut strip core in region B of FIG. 1, the cut strip core consisting of separate side walls and a separate channel bottom.

Shown in FIG. 4A is a preferred embodiment, in which the carrier 3 consists of separate side walls 3*b* and a separate channel bottom 3*a*. The channel bottom 3*a* of carrier 3 is a hollow cylinder built up from a plurality of transformer sheets stacked in radial direction. The side walls 3*b* of carrier 3 comprise a plurality of axially stacked, annular transformer sheets. The leakage field extending between channel bottom 3*a* and side walls 3*b* is very small. As a result, there is no influence is on the generated current and, thus, on the temperature in godet jacket 2.

Figure 4B:
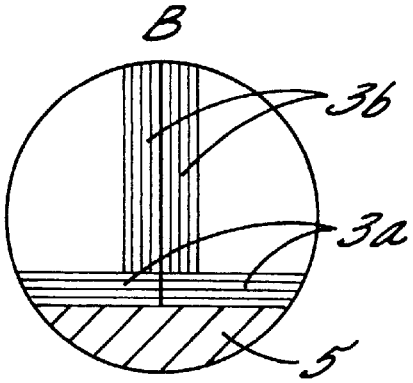

Shown in FIG. 4B is another preferred embodiment, in which the carrier 3 consists of separate side walls 3*b* and a separate bottom 3*a*. The bottom 3*a* of carrier 3 is a hollow cylinder built up from a plurality of transformer sheets stacked in radial direction. The side walls 3*b* of cut strip core 3 comprise a plurality of stacked annular transformer sheets. The axial leakage field extending between channel bottom 3*a* and side walls 3*b* is very small, which has no influence on the generated current and, thus, on the temperature in godet jacket 2.

Figure 4C:
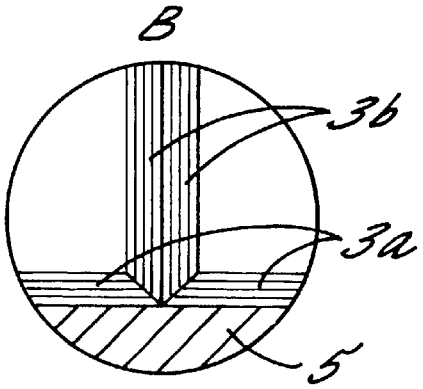

Shown in FIG. 4C is another preferred embodiment, in which the carrier 3 consists of separate side walls 3*b* and a separate bottom 3*a*. The bottom 3*a* of cut strip core 3 is a hollow cylinder built up from a plurality of transformer sheets stacked in radial direction. The side walls 3*b* of carrier 3 comprise a plurality of stacked annular transformer sheets. The oblique leakage field extending between channel bottom 3*a* and side walls 3*b* is very small. As a result, there is no influence on the generated current and, thus, on the temperature in godet jacket 2.

Figure 6:
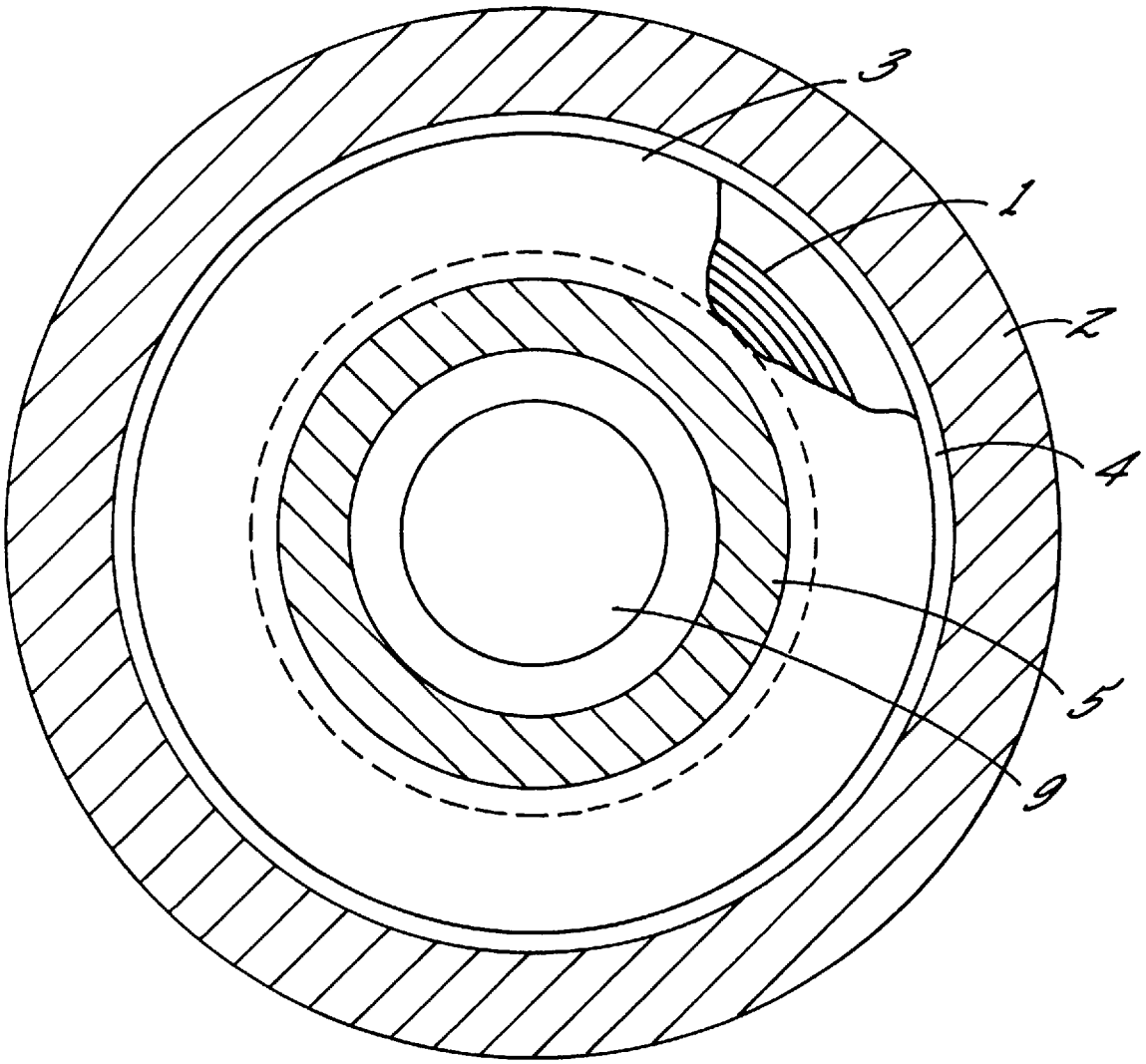
FIG. 6 is a sectional view of the godet of FIG. 1, and FIG. 4A, or 4B, or 4C, the Figure illustrating an annular separate side wall 3*b;*

FIG. 6 illustrates a form of side wall 3*b*, which can be combined both with the arrangement of FIG. 4A and with the arrangement of FIG. 4B. The side wall 3*b* is stacked from a plurality of annular transformer sheets. This arrangement is especially low in losses, since the radial clearance 4 between side wall 3*b* and godet jacket 2 is made substantially constant in circumferential direction.

Figure 7:
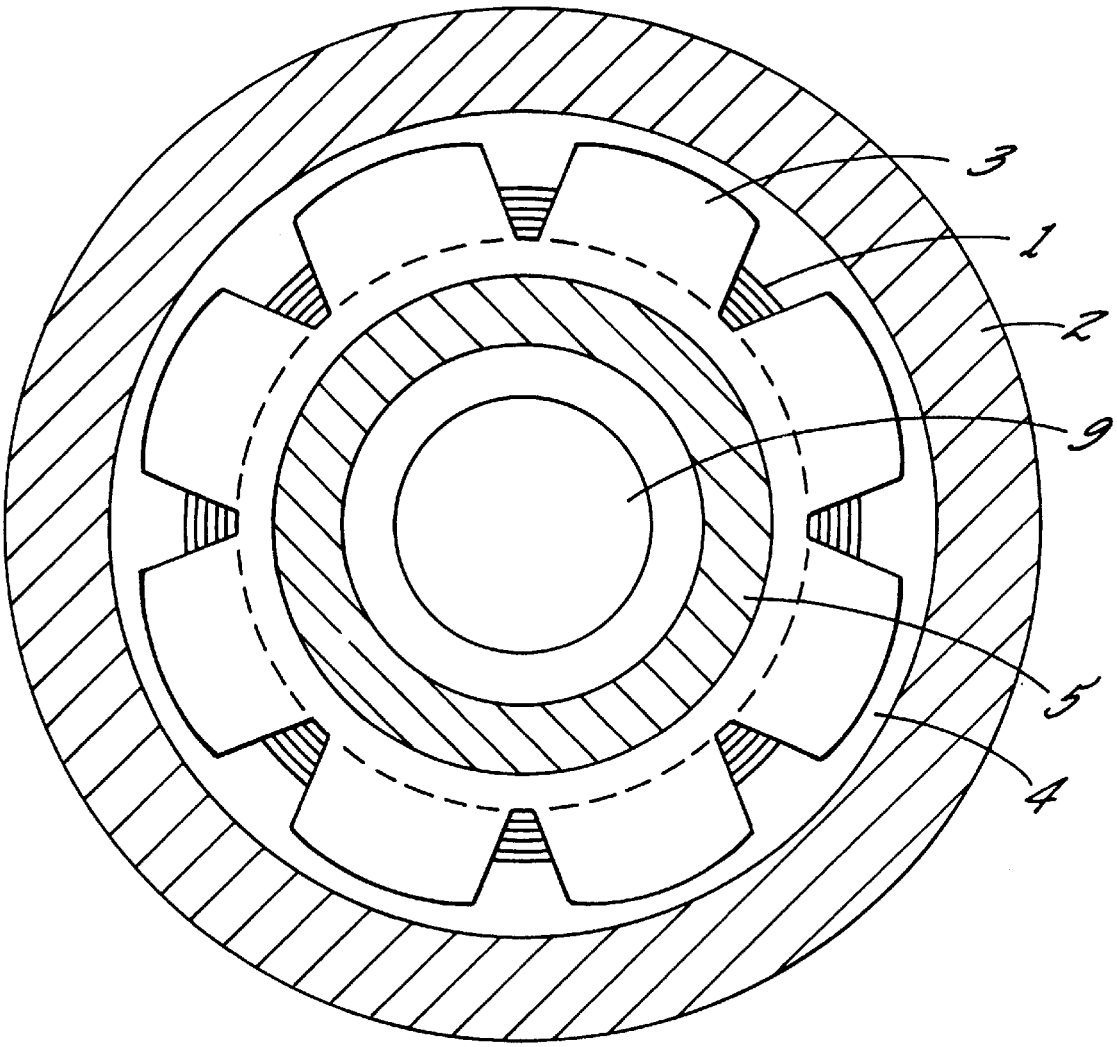
FIG. 7 is a sectional view similar to FIG. 6, the illustrated annular side wall 3*b* being made star-shaped.

FIG. 7 illustrates another form of side wall 3*b*, which can be combined both with the arrangement of FIG. 4A and with the arrangement of FIG. 4B. In this configuration, each annular transformer sheet has a star-shaped outer edge. The transformer sheets are axially stacked, so that the star-shaped outer edges are axially aligned one after the other.

Figure 8:
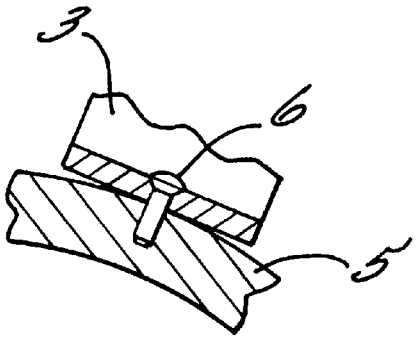
FIG. 8 is a partial view illustrating the mount of the cut strip core on the coil support.

FIG. 8 illustrates a possible mount of carrier 3 to coil support 5, wherein each of carriers 3 which are made, for example, as cut strip cores, is attached by means of at least one screw 6 to coil support 5 of godet 2.

The application of U-shaped, laminated transformer sheets, in particular cut strip cores, has furthermore the advantage that the thin metal sheets as are required for a high-frequency application can be used of a thickness as small as 0.01 mm. Since the depth of penetration of the magnetic flux decreases as frequency increases and, however, since performance of the magnetic flux occurs exclusively on the surface, such thin sheets are needed to keep power losses at a lower level.

That which is claimed is:

1. A godet for guiding and heating an advancing yarn, comprising a support member, a shaft rotatably mounted to the support member so as to rotate about the axis of the shaft, a tubular coil support fixed to said support member so as to coaxially surround said shaft, a jacket which includes a magnetically conductive tubular wall, means fixedly mounting said jacket to said shaft so as to rotate therewith about said axis of said shaft and so that the tubular wall of the jacket overlies the tubular coil support and is adapted to be contacted by the advancing yarn, induction coil heating means mounted to said tubular coil support so as to lie between the coil support and the tubular wall of the jacket, said heating means comprising a plurality of annular carriers mounted in an axially adjacent arrangement along said coil support, each of said annular carriers being of U-shape in axial cross section and comprising a bottom wall and opposite side walls, and wherein said bottom wall of each of said carriers comprises a plurality of axially extending transformer sheets which radially overlie each other, and said heating means further comprising an induction coil mounted coaxially within each of said annular carriers, whereby an alternating current delivered to each of said induction coils induces a secondary current in said tubular wall of said jacket to heat the jacket.

2. The godet as defined in claim 1 wherein said side walls of each of said carriers comprise a plurality of transformer sheets which extend radially and overlie each other in the axial direction.

3. The godet as defined in claim 2 wherein the transformer sheets which comprise the bottom wall and side walls of each of said carriers are composed of common sheets of U-shape.

4. The godet as defined in claim 2 wherein the transformer sheets which comprise the bottom wall and side walls of each of said carriers are composed of separate sheets forming the bottom wall and side walls respectively.

5. The godet as defined in claim 4 wherein the separate sheets of the bottom wall of each of said carriers are each in the form of a hollow cylinder.

6. The godet as defined in claim 5 wherein the separate sheets of the side walls of each of said carriers are in the form of an annular ring.

7. The godet as defined in claim 6 wherein the separate sheets of the side walls of each of said carriers are star shaped.

8. The godet as defined in claim 6 wherein the side walls of each of said carriers each include an outer circumferential edge which is closely adjacent and closely conforms to the curvature of the tubular wall of the jacket.

9. The godet as defined in claim 1 wherein each of said carriers comprises a plurality of circumferentially adjacent segments.

10. The godet as defined in claim 9 wherein the bottom wall of each of said segments is substantially flat and tangentially contacts the surface of the coil support.

11. The godet as defined in claim 9 wherein the side walls of each of said segments include an outer circumferential edge which is closely adjacent and closely conforms to the curvature of the tubular wall of the jacket.

12. The godet as defined in claim 9 wherein the bottom wall of each of said segments closely conforms to the surface of the coil support.

13. The godet as defined in claim 9 wherein the segments of axially adjacent carriers are circumferentially offset from each other.

14. The godet as defined in claim 1 wherein each of the carriers is secured to the coil support by means of at least one screw.

15. The godet as defined in claim 1 wherein the transformer sheets have a thickness not substantially greater than 0.01 mm.

* * * * *